US008424115B2

(12) United States Patent
Greer

(10) Patent No.: US 8,424,115 B2
(45) Date of Patent: Apr. 23, 2013

(54) WRISTBAND WITH CONTOURED COMFORT SIDES

(75) Inventor: Mark Greer, O'Fallon, MO (US)

(73) Assignee: Laser Band, LLC, Saint Louis, MO (US)

( * ) Notice: Subject to any disclaimer, the term of this patent is extended or adjusted under 35 U.S.C. 154(b) by 1342 days.

(21) Appl. No.: 11/553,873

(22) Filed: Oct. 27, 2006

(65) Prior Publication Data

US 2008/0109937 A1 May 15, 2008

(51) Int. Cl.
*A41D 20/00* (2006.01)

(52) U.S. Cl.
USPC ..... 2/170

(58) Field of Classification Search ..... 2/16, 59, 2/60, 162, 170; 40/633
See application file for complete search history.

(56) References Cited

U.S. PATENT DOCUMENTS

| | | | | |
|---|---|---|---|---|
| 230,455 | A | 7/1880 | Wilcox | |
| 919,983 | A | 4/1909 | Walsh | |
| 922,948 | A | 5/1909 | Portmore | |
| 1,517,456 | A | 12/1924 | Pulliam | |
| 2,054,227 | A | 9/1936 | Nichols | |
| 2,073,280 | A * | 3/1937 | Lederer | 40/633 |
| 2,553,676 | A | 5/1951 | Roos | |
| 2,641,074 | A * | 6/1953 | Richmond | 40/633 |
| 3,197,899 | A | 8/1965 | Twentier | |
| 3,402,808 | A | 9/1968 | Yannuzzi | |
| 3,660,916 | A | 5/1972 | McDermott et al. | |
| 3,854,229 | A | 12/1974 | Morgan | |
| 4,004,362 | A | 1/1977 | Barbieri | |
| 4,078,324 | A | 3/1978 | Wiebe | |
| 4,179,833 | A | 12/1979 | Knodel | |
| 4,226,036 | A | 10/1980 | Krug | |
| 4,233,715 | A | 11/1980 | McDermott | |
| 4,612,718 | A | 9/1986 | Golub et al. | |
| 4,627,994 | A | 12/1986 | Welsch | |
| 4,682,431 | A | 7/1987 | Kowalchuk | |
| 4,696,843 | A | 9/1987 | Schmidt | |
| 4,783,917 | A | 11/1988 | Smith et al. | |
| 4,829,604 | A | 5/1989 | Allen et al. | |
| 4,854,610 | A | 8/1989 | Kwiatek | |
| 4,855,277 | A | 8/1989 | Walter | |
| 4,914,843 | A | 4/1990 | DeWoskin | |

(Continued)

FOREIGN PATENT DOCUMENTS

| | | |
|---|---|---|
| EP | 1039431 | 9/2000 |
| FR | 2806594 A | 9/2001 |

(Continued)

OTHER PUBLICATIONS

Avery Dennison DuraCard™.

(Continued)

*Primary Examiner* — Katherine Moran
*Assistant Examiner* — S. Haden
(74) *Attorney, Agent, or Firm* — Alston & Bird LLP

(57) ABSTRACT

A bending yielding feature for use along an edge of any flexible wristband design provides a cushioning effect to a wearer's wrist or ankle as the wristband is worn, thereby helping to prevent injury to the wearer's wrist or ankle as he flexes his wrist or ankle against the wristband. The bending yielding feature can include many edge designs such as a scalloped edge, a curved edge, an edge with a series of extending flaps, and other such shapes.

6 Claims, 4 Drawing Sheets

U.S. PATENT DOCUMENTS

| | | | | |
|---|---|---|---|---|
| 4,941,210 | A | | 7/1990 | Konucik |
| 4,956,931 | A | | 9/1990 | Selke |
| 4,991,337 | A | | 2/1991 | Solon |
| RE33,616 | E | | 6/1991 | Welsch |
| 5,026,084 | A | | 6/1991 | Pasfield |
| 5,045,426 | A | | 9/1991 | Maierson et al. |
| 5,135,789 | A | | 8/1992 | Schmidt |
| 5,222,823 | A | | 6/1993 | Conforti |
| 5,227,004 | A | | 7/1993 | Belger |
| 5,227,209 | A | | 7/1993 | Garland |
| 5,283,969 | A | | 2/1994 | Weiss |
| 5,311,689 | A | | 5/1994 | Lindsey |
| 5,318,326 | A | | 6/1994 | Garrison |
| 5,351,993 | A | | 10/1994 | Wright |
| 5,370,420 | A | | 12/1994 | Khatib et al. |
| 5,383,686 | A | | 1/1995 | Laurash |
| 5,418,026 | A | | 5/1995 | Dronzek, Jr. et al. |
| 5,427,416 | A | | 6/1995 | Birch |
| 5,486,021 | A | | 1/1996 | Laurash |
| 5,486,436 | A | | 1/1996 | Lakes |
| 5,509,693 | A | | 4/1996 | Kohls |
| 5,509,694 | A | | 4/1996 | Laurash et al. |
| 5,518,787 | A | | 5/1996 | Konkol |
| 5,524,934 | A | | 6/1996 | Schwan et al. |
| 5,547,227 | A | | 8/1996 | Laurash et al. |
| 5,581,924 | A | | 12/1996 | Peterson |
| 5,586,788 | A | | 12/1996 | Laurash |
| 5,595,404 | A | | 1/1997 | Skees |
| 5,598,970 | A | | 2/1997 | Mudry et al. |
| 5,601,313 | A | | 2/1997 | Konkol et al. |
| 5,630,627 | A | | 5/1997 | Stewart |
| 5,637,369 | A | | 6/1997 | Stewart |
| 5,648,143 | A | | 7/1997 | Mehta et al. |
| 5,653,472 | A | | 8/1997 | Huddleston et al. |
| 5,662,976 | A | | 9/1997 | Popat et al. |
| 5,687,903 | A | | 11/1997 | Akridge et al. |
| 5,765,885 | A | | 6/1998 | Netto |
| 5,842,722 | A | | 12/1998 | Carlson |
| 5,877,742 | A | * | 3/1999 | Klink ..... 345/685 |
| 5,933,993 | A | | 8/1999 | Riley |
| 5,984,363 | A | | 11/1999 | Dotson et al. |
| 6,000,160 | A | | 12/1999 | Riley |
| 6,006,460 | A | | 12/1999 | Blackmer |
| 6,016,618 | A | | 1/2000 | Attia et al. |
| 6,053,535 | A | | 4/2000 | Washburn et al. |
| 6,067,739 | A | | 5/2000 | Riley |
| 6,071,585 | A | | 6/2000 | Roth |
| 6,092,321 | A | | 7/2000 | Cheng et al. |
| 6,155,476 | A | | 12/2000 | Fabel |
| 6,155,603 | A | | 12/2000 | Fox |
| 6,159,570 | A | | 12/2000 | Ulrich et al. |
| 6,303,539 | B1 | | 10/2001 | Kosarew |
| 6,331,018 | B1 | | 12/2001 | Roth et al. |
| 6,343,819 | B1 | | 2/2002 | Shiozaki |
| 6,361,078 | B1 | | 3/2002 | Chess |
| 6,409,871 | B1 | | 6/2002 | Washburn et al. |
| 6,438,881 | B1 | | 8/2002 | Riley |
| 6,510,634 | B1 | | 1/2003 | Riley |
| 6,517,921 | B2 | | 2/2003 | Ulrich et al. |
| 6,611,962 | B2 | | 9/2003 | Redwood et al. |
| 6,685,228 | B2 | | 2/2004 | Riley |
| 6,748,687 | B2 | | 6/2004 | Riley |
| 6,807,680 | B2 | | 10/2004 | Sloot |
| 6,836,215 | B1 | | 12/2004 | Laurash et al. |
| 6,863,311 | B2 | | 3/2005 | Riley |
| 7,017,293 | B2 | | 3/2006 | Riley |
| 7,017,294 | B2 | | 3/2006 | Riley |
| 7,047,682 | B2 | | 5/2006 | Riley |
| 7,222,448 | B2 | | 5/2007 | Riley |
| 7,240,446 | B2 | | 7/2007 | Bekker |
| 2002/0176973 | A1 | | 11/2002 | Keiser |
| 2003/0011190 | A1 | | 1/2003 | Ryan |
| 2004/0068906 | A1 | | 4/2004 | Riley |
| 2004/0244251 | A1 | | 12/2004 | Riley |
| 2005/0108912 | A1 | | 5/2005 | Bekker |
| 2005/0279001 | A1 | | 12/2005 | Riley |
| 2005/0281989 | A1 | | 12/2005 | Finger |
| 2006/0230661 | A1 | | 10/2006 | Bekker |
| 2006/0236578 | A1 | | 10/2006 | Saint et al. |
| 2007/0089342 | A1 | * | 4/2007 | Jain et al. ..... 40/633 |

FOREIGN PATENT DOCUMENTS

| | | | |
|---|---|---|---|
| GB | 960859 | | 6/1964 |
| GB | 2045718 | | 11/1980 |
| GB | 2160492 | | 12/1985 |
| GB | 2228915 | A | 9/1990 |
| JP | 2002351321 | A | 12/2002 |
| JP | 2003066849 | | 3/2003 |
| JP | 2003157010 | | 5/2003 |
| JP | 2003164307 | | 6/2003 |
| JP | 2006039209 | | 2/2006 |
| WO | WO 96/12618 | | 5/1996 |
| WO | WO 98/23081 | | 5/1998 |
| WO | WO 99/18817 | | 4/1999 |
| WO | WO 02/039412 | | 5/2002 |
| WO | WO 03/000331 | | 1/2003 |
| WO | WO 2004/028826 | | 4/2004 |
| WO | WO 2006/007356 | | 6/2005 |
| WO | WO 2005/064574 | | 7/2005 |
| WO | 2007/021375 | | 2/2007 |
| WO | 2007/133906 | | 11/2007 |

OTHER PUBLICATIONS

Avery® Laminated Identification Cards #5361.

Brochure entitled: "Color-Bar® Click Strip™" Label System; Smead Manufacturing Company; Date Unknown; Form No. SSS-CS-00.

Brochure entitled: "Color-Bar® Folders"; Smead Manufacturing Company; Date Unknown.

Brochure entitled: "Integrated Document Management Software"; Smead Manufacturing Company; Date Unknown; Form No. SLI-95.

Catalog entitled: "Reseller Catalog Number One"; Smead Software Solutions™; Date Unknown; Form No. SSS-RC1-00.

Sample of Standard Register Labels.

Standard Register, *P.S. Magazine*, Fall 1998, Dayton, Ohio.

Gretchen Berry, "Wrist Watch," *Advance for Healthcare Information Professionals*, Feb. 15, 1999.

Sample of Standard Register Label.

"Yes, Sir, That's My Baby!," *Material Management in Health Care*, Feb. 1999, vol. 8, No. 2, Health Forum, Inc.

Disaster Management Systems, Inc., Triage Tag, Copyright 1996, Pomona, California.

Maryland Department of Transportation, Maryland Emergency Medical Services, Triage Tag, Copyright MIEMMS 1999, Maryland.

Posey Movable I.D. Bracelet; downloaded from http.:/www.posey.com/products/4648.html on Aug. 18, 2004.

ID Warehouse (http://web.archive.org/web/20050131235601/http://idwarehouse.com/) Jan. 31, 2005. p. 1: WB1908, Stock Vinyl Wristband.

* cited by examiner

WRISTBAND WITH CONTOURED COMFORT SIDES

CROSS-REFERENCE TO RELATED APPLICATIONS

This application is related to two other applications being filed concurrently herewith. They are "Wristband with Snap Closure and Patient ID Label" having Ser. No. 11/553,872; and "Laminate Web Wristband" having Ser. No. 11/553,891; both of even filing date herewith and the disclosures of which are incorporated herein by reference.

BACKGROUND AND SUMMARY OF THE INVENTION

Wristbands for use in admitting and identifying patients for both in patient and out patient care are routinely used in the medical community today. The assignee hereof owns a number of patents disclosing and claiming various inventive wristband suited to this medical field application, and which have experienced great commercial success. Examples of these include U.S. Pat. Nos. 5,933,993; 6,000,160; 6,067,739; 6,438,881; 6,510,634; 6,748,687; 7,047,682; 7,017,293; and 7,017,294, the disclosures of which are incorporated herein by reference. These patented wristbands have been made and sold by the millions. Some are sized for use on adults and others are sized for use on infants and even newborns having the smallest of wrists or ankles. The wristband designs shown in these prior patents have straight edges along their length, and they have been accepted as safe and comfortable for all their intended users. Nevertheless, as demonstrated by the continuing series of patent filings, the assignee has endeavored to continuously improve its wristband designs to the continuing benefit of the consuming public.

In many wristband designs, especially in those wristbands which are thin, an edge is created along its length which, for wearers with sensitive skin such as newborn babies, or should the wristband be inadvertently applied too tightly about the wearer's wrist or ankle, could actually create an abrasion or even a fine cut (like a paper cut) in the wearer's wrist or ankle. For newborns, some of whom have wristbands placed on both ankles, the wristband on the right leg could cause an abrasion or cut on the left leg as the baby thrashes about, and vice versa. While these instances are rare, and would ordinarily be avoided by a careful and attentive medical staff, it does provide an opportunity for improvement. It is noted that for convenience the word "wrist" is intended to refer to any limb and the phrase "wristband" is intended to refer to a band worn around any limb.

As a result of the assignee's continuing efforts to improve these wristband designs, the inventor herein has succeeded in designing an improvement which increases the comfort, and reduces the risk of harm, for not only the assignee's designs but also virtually all other flexible wristbands. In simple terms, the inventor has succeeded in developing a "bending yielding feature" for softening the edge pressure exerted by the edges of the wristband to the wearer's wrist or ankle. This bending yielding feature is especially useful for wristband designs in popular use today which are made of flexible vinyl or other thin plastic laminates. These materials are quite strong which allow them to be made from especially thin or lightweight plies, thereby increasing the likelihood that they exhibit a sharp edge which when pressed against the wrist or ankle is likely to cut or abrade it.

In simple terms, a "bending yielding feature" can be understood as any design that, inter alia, essentially adds "yieldability", adds flex, or presents a smooth surface to a wearer's skin. In essence, a non-linear edge would seem to the inventor to satisfy this requirement. Examples of this feature include a scalloped edge design, a "toothed" edge design, a "slotted" edge design, a "folded over" edge design, and other "non-straight" edges. Some of these designs extend the length of the edge to be longer than a straight line measurement. Others of these designs provide design elements that are more flexible than a simple straight edge would provide. Still others, such as a folded over edge, provide an actual cushion at the edge which comes into contact with the wearer's wrist as the wrist is flexed or ankle as it is flexed. All are enough to help prevent a sharp edge from coming into contact with the wearer's wrist or ankle as the wrist or ankle is flexed.

In some wristband designs, there is an information receiving area or panel of the wristband that is usually wider (but need not be) than a strap portion or otherwise designated to receive information. For those designs having one portion of the wristband wider than other portions, it is considered preferable that the bending yielding feature be applied along the wider portion as that portion is normally the part of the wristband that comes into contact with the wrist or ankle first. It is also considered preferable that the bending yielding feature be formed along substantially the entire length of both opposing sides of the wider panel portion. Should there be no portion wider than another, as is the case for some designs shown in the assignee's patents identified above, then it is considered preferable that the bending yielding feature be formed along substantially the entirety of at least one side of the length that ordinarily would come into contact with a wearer's wrist or ankle as the wristband is worn and the wrist or ankle is flexed. However, forming the feature in both sides is considered to also be beneficial and is intended as one embodiment of the present invention.

While the principal advantages and features of the invention have been described above, a greater understanding may be attained by referring to the drawings and detailed description of the preferred embodiment that follows.

DETAILED DESCRIPTION OF THE PREFERRED EMBODIMENT

Figure 1:
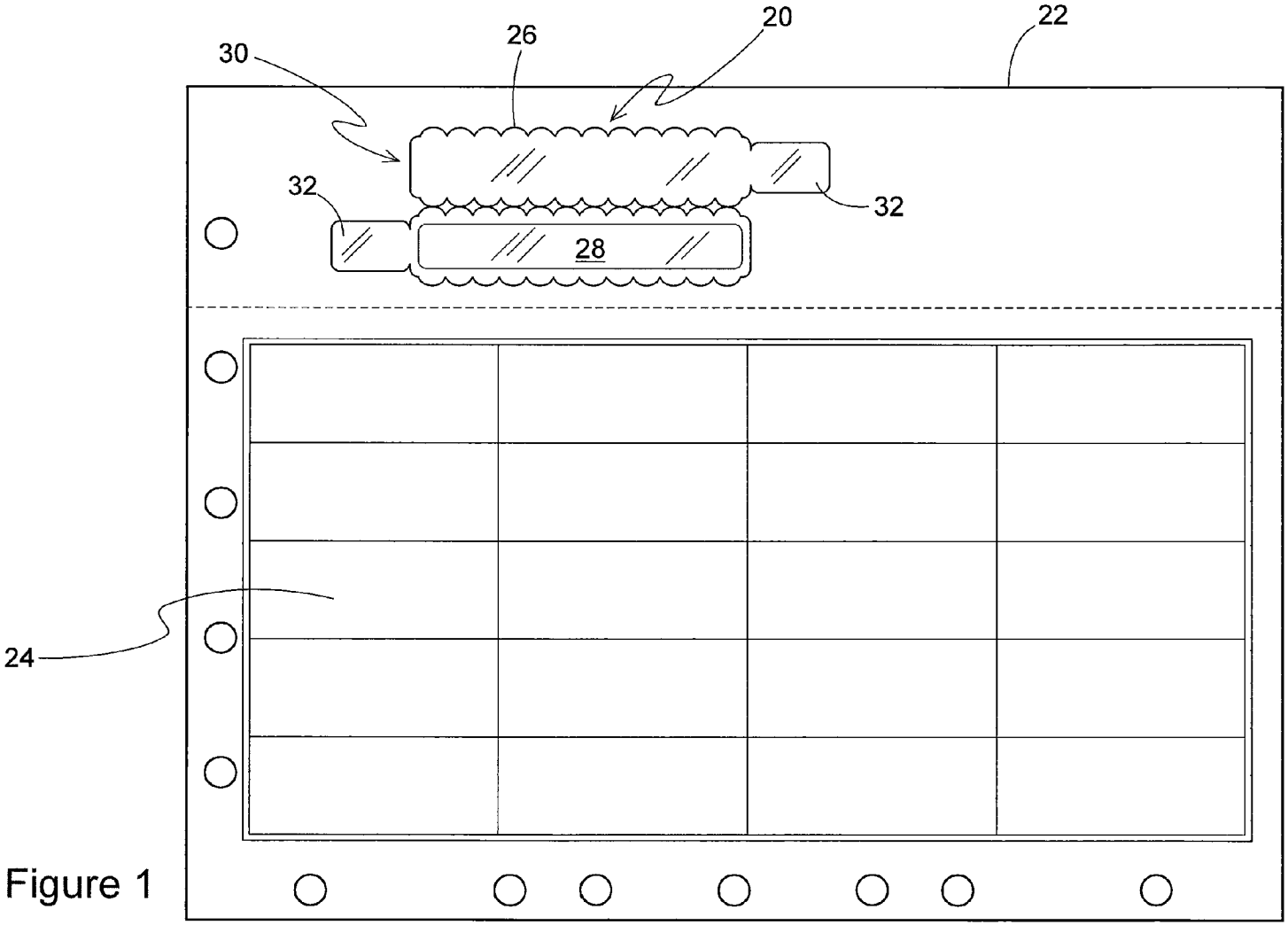
FIG. 1 is a plan view of a business form comprising a wristband and label sheet, with the wristband having a bending yielding feature formed along the length of an information receiving panel.

As shown in FIG. 1, the first patented wristband design 20 as included on a page sized sheet 22 along with a matrix of self adhering labels 24 may be readily adapted for application of the bending yielding feature 26 of the present invention. The wristband design 20 includes an imaging or printable face stock area 28 upon which is printed a patient's name, attending doctor's name, a bar code, etc. and then a clamshell lamination ply 30 is folded over to substantially encapsulate the face stock area 28 with a pair of integrally formed self adhering tabs 32 used for attaching the wristband to the patient. This construction is described in greater detail in several of the patents mentioned above.

Figure 3:
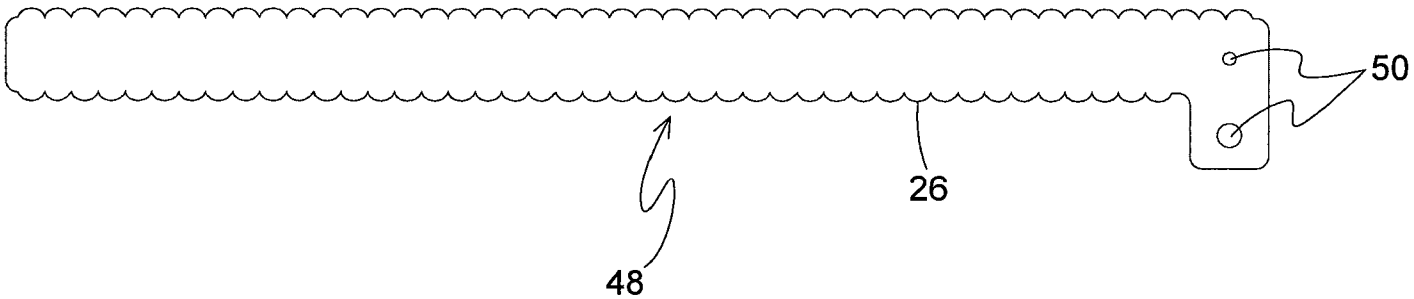
FIG. 3 is a plane view of a wristband with a bending yielding feature found along both sides thereof.

The bending yielding feature 26 is shown as preferably being a scallop shaped design although any of the other designs shown in FIG. 3 could be used as well. The scallop shaped design presents a design that is visually pleasing, does not create any "loose ends" as in other designs which might either separate or be caught in something as the limb is moved about, minimizes the chances for developing a crease or sharp edge, and which also distributes the load across a larger surface area. It is noted that the bending yielding feature 26 provides some "give" should either edge come into contact with the wearer's wrist or ankle as the wristband is worn. Although the inventor has not yet conducted testing to ascertain the optimal angles, degree of curvature, etc. as would yield best results, the inventor does believe that different radius of curvature would be appropriate depending on the length of the wristband on which a scallop design would be used. For a shorter wristband, it is anticipated that a smaller radius of curvature and hence greater periodicity of the yielding feature would be desirable.

Figure 2:
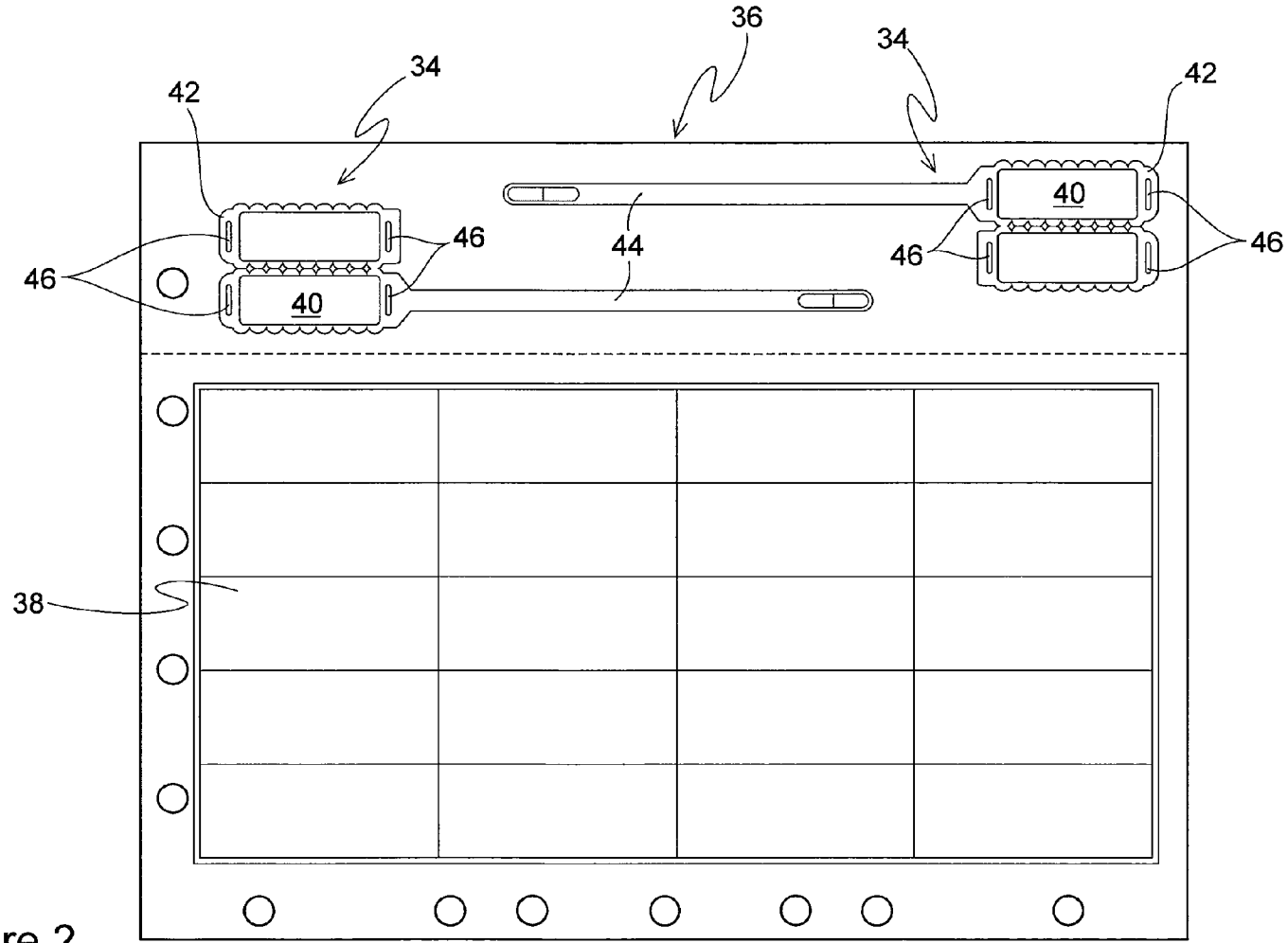
FIG. 2 is a plan view of a business form comprising a wristband and label sheet, with the wristband having an information receiving area extending along substantially the entire length of the wristband, and a bending yielding feature formed along the length thereof.

As shown in FIG. 2, the second patented wristband design 34 as included on a page sized sheet 36 along with a matrix of self adhering labels 38 may also be readily adapted for application of the bending yielding feature 26 of the present invention. This wristband design 34 also includes an imaging or printable face stock area 40 although the area 40 does not extend the full length of the wristband 34, and a clamshell lamination ply 42 having a narrower strap 44 and one or more cinch slots 46 are used to attach the wristband onto a patient's wrist or ankle. In this design, as a patient flexes his wrist or ankle, it is thought that the edges of the clamshell 42 adjacent the imaging area 40 are much more likely to come into contact with the patient and hence it is preferred that just these edges receive the bending yielding feature 26.

The bending yielding feature 26 is similarly shown as a scallop design although other designs could be used as well.

FIG. 3 discloses a straight wristband 48, with no panel or designated information receiving area, in which the bending yielding feature 26 is provided along a substantial portion of one longitudinal edge thereof. The particular design shown also has a snap closure 50 at its end, although any suitable closure could be used as known by those of skill in the art. As mentioned herein, this bending yielding feature 26 may extend along substantially the entirety of the length of the band, or along only a relatively short portion of the length and just enough to soften the impact of the band as it comes into contact with the wearer's limb.

Figure 4A:
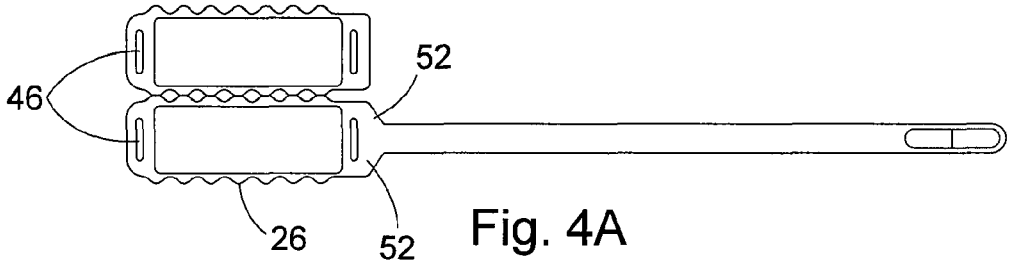
FIGS. 4A-E are a series of top views each depicting a different embodiment of a bending yielding feature.
Figure 4B:
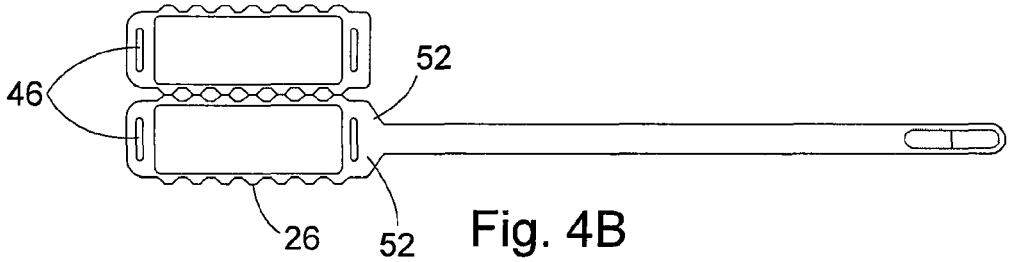
Figure 4C:
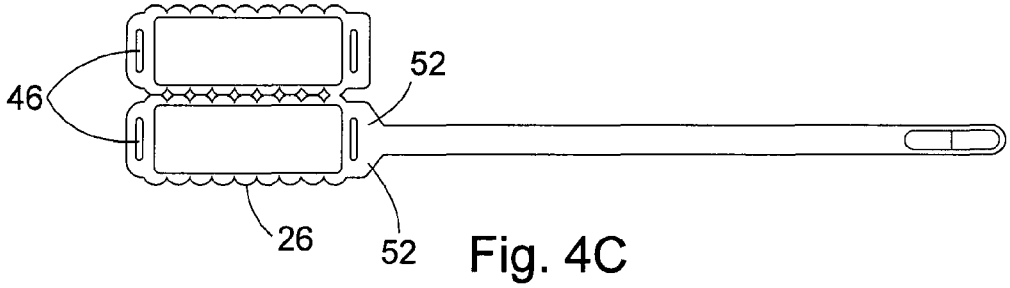
Figure 4D:
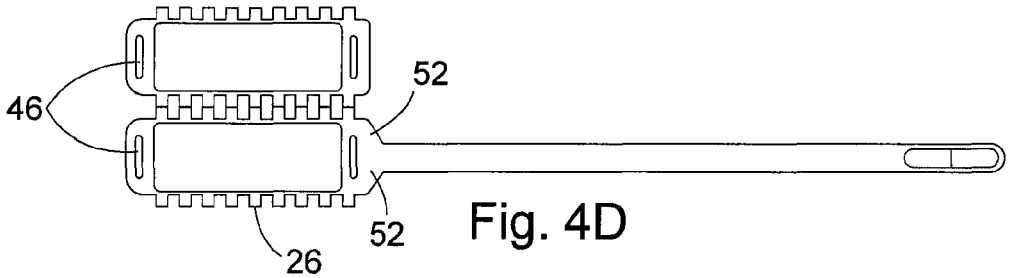
Figure 4E:
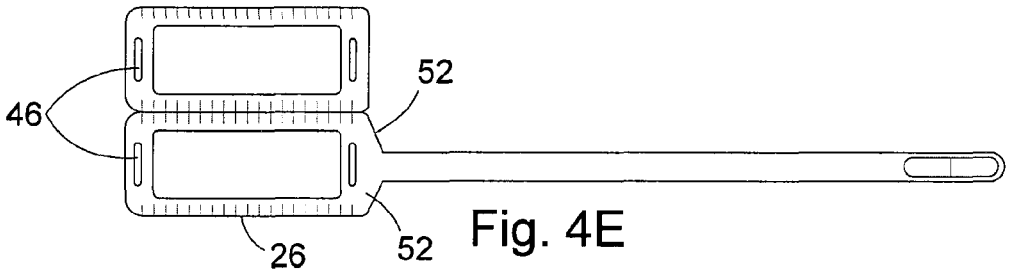

FIG. 4A-E depict different shapes and designs for the bending yielding feature 26 which are all believed to exhibit the desired effect, i.e. that of softening or making it more yielding or lengthening the edge to increase the comfort of the wearer. As shown in FIG. 4A, the bending yielding feature 26 may be shaped as a generous curve or scallop, preferably extending from near the front shoulder 52 of both halves of the clamshell 42 to end near the outboard cinch slot 46. As shown in FIG. 4B, the bending yielding feature 26 may be shaped as more pronounced and regular, with flattened pyramids extending outwardly. As shown in FIG. 4C, the bending yielding feature 26 may be shaped as a continuous half or semi-circle pattern, resembling an arrangement of petals along the edge. As shown in FIG. 4D, the bending yielding feature 26 may be shaped as a Greek key, or series of spaced rectangular flaps. As shown in FIG. 4E, the relieved edge may be formed by a series of die cuts which creates a series of adjacent rectangular flaps.

Although a number of arrangements and designs are explicitly shown herein for the bending yielding feature, one of skill in the art would find other arrangements and designs apparent from the teaching provided. For example, a folded edge design might also be provided which would in effect provide a "bumper" to cushion the wristband against the wearer's wrist or ankle. Other designs would also be apparent and are intended to be included within the scope of the invention. Accordingly, the present invention is disclosed herein in terms of its preferred embodiment solely to be illustrative and not limiting in any way. Instead, the scope of the present invention should be limited solely by the legal scope of the claims and their equivalents.

What is claimed is:

1. A self laminating wristband having a strap portion, a wider information receiving area, and a cinch for attaching the wristband to a wearer's limb, at least said strap portion and information receiving area being formed in a single layer of material, the information receiving area having a bending yielding feature along at least one of its edges.

2. The wristband of claim 1 wherein said bending yielding feature extends along opposing edges of said information receiving area.

3. The wristband of claim 2 wherein said bending yielding feature extends along substantially the entirety of said opposing edges.

4. The wristband of claim 3 wherein said bending yielding feature comprises a contoured edge.

5. The wristband of claim 4 wherein said contoured edge comprises a scalloped edge.

6. A self laminating wristband comprising a first information receiving ply, and a second clamshell laminating ply for folding over and substantially encapsulating the information receiving ply, and a strap portion integrally formed with said second clamshell laminating ply, said second clamshell laminating ply having a bending yielding feature extending along its opposing side edges and along at least part of its length adjacent the information receiving ply.

* * * * *